US005099914A

United States Patent [19]

Reifel

[11] Patent Number: 5,099,914

[45] Date of Patent: Mar. 31, 1992

[54] LOUVERED HEAT EXCHANGER FIN STOCK

[75] Inventor: Allan J. Reifel, Florissant, Mo.

[73] Assignee: Nordyne, Inc., St. Louis, Mo.

[21] Appl. No.: 617,571

[22] Filed: Nov. 26, 1990

Related U.S. Application Data

[63] Continuation-in-part of Ser. No. 447,924, Dec. 8, 1989, abandoned.

[51] Int. Cl.[5] ..... F28D 1/04

[52] U.S. Cl. ..... 165/151; 165/152

[58] Field of Search ..... 165/151, 152, 153

[56] References Cited

U.S. PATENT DOCUMENTS 4,365,667 12/1982 Hatada et al. ..... 165/152
4,469,167 9/1984 Itoh et al. ..... 165/151
4,756,362 7/1988 Kudoh et al. ..... 165/151

FOREIGN PATENT DOCUMENTS 119494 9/1981 Japan ..... 165/152
194194 8/1987 Japan ..... 165/151
251794 10/1988 Japan ..... 165/151
2125529 3/1984 United Kingdom ..... 165/151

*Primary Examiner*—John Rivell
*Assistant Examiner*—L. R. Leo
*Attorney, Agent, or Firm*—Jerome A. Gross

[57] ABSTRACT

Bi-directional fin stock, for use in heat exchangers of the fin and tube type, having louvers formed from the planar surface of the fin stock to project progressively farther into the airstream. This enables the fin stock to exchange heat with a broader airstream by translating the airflow substantially, permitting wider fin spacing.

6 Claims, 2 Drawing Sheets

FIG. 1
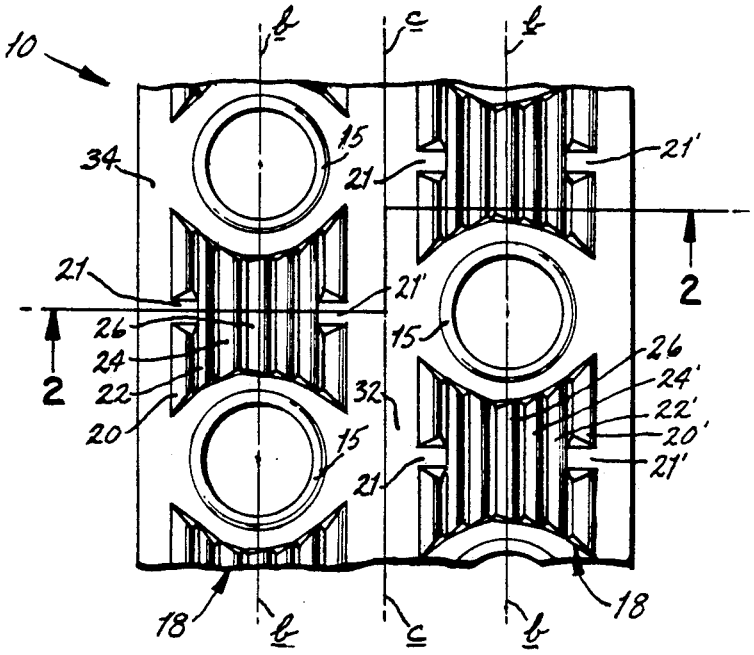
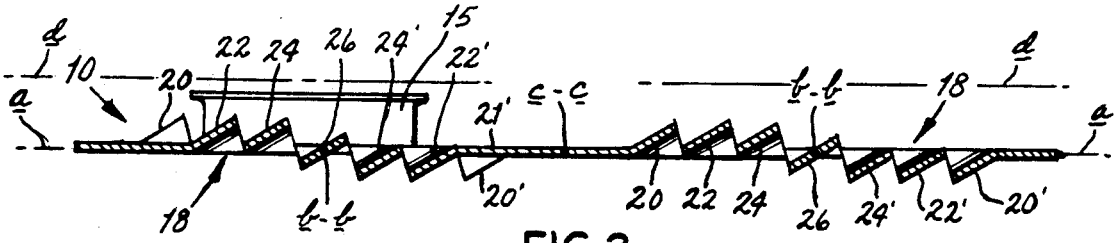
FIG. 2

LOUVERED HEAT EXCHANGER FIN STOCK

CROSS-REFERENCE TO RELATED APPLICATIONS

This application is a continuation-in-part of application Ser. No. 07/447,924, filed Dec. 8, 1989, entitled "Bi-Directional Heat Exchanger Fin Stock," to be abandoned.

BACKGROUND OF THE INVENTION

1. Field of the Invention

This invention relates to improvements in the fin stock for use in fin and tube heat exchangers, and in particular to achieving improved heat transfer by improved louver patterns therein.

2. Description of the Prior Art

It is well known to use lances through generally planar metal heat exchanger fin stock to displace metal to one side of its plane and thus interfere with and achieve greater heat exchange with the flowing air. Similarly, louvered fin stock may be used. The term "lances" as conventionally used means elongated portions slit and displaced; the term "louvers" means similar portions which are also slanted away from the plane of the fin stock.

For optimum heat exchange efficiency, each portion of the finned heat exchanger should be subjected to air of maximum temperature differential. In the design of louvered stock according to the present invention, this principle is utilized, to the extent feasible, so that the heat exchange capacity of those fin portions subsequent to the first in the line of air flow should not be wasted on air already heated by flow over those first fin portions.

It is conventional to form identical louvers or lances in a progression of identical louvers bent to one side of the plane of the fin stock, with their outstanding edges in a plane parallel to that of the fin stock. In such a progression, only the first louver in the line of airflow encounters the coolest air; after it exchanges heat to the air, that same air, now heated, encounters the subsequent louvers; these function at a reduced temperature differential, with a loss of heat exchange efficiency.

The patent to Seo, Japan, No. 194,194 shows that such a progression of louvers may have both edges of the louvers in planes displaced from but parallel to the plane of the fin stock. Seo's progression is disadvantaged by the same reduced temperature differential for heat transfer.

An extensive theoretical discussion is included in the paper by Kadambi and Giansante, "The Effect of Lances on Finned-Tube Heat Exchanger Performance" 1983, Volume 9, Part 1, *American Society of Heating, Refrigerating and Air-Conditioning Engineers, Inc.*, Paper No. 2741. Lances or louvers are recognized as increasing the heat exchange of fin stock, though with some increase in power required; and in the Kadambi publication above referred to, it is stressed that their appropriate use will permit greater spacing between fins, and hence the use of less fin stock.

SUMMARY OF THE PRESENT INVENTION

In the present invention the leading edges of some or all successive louvers are so staggered as to scoop up successive shallow portions or segments of the airflow. Each airflow portion flows along a different louver surface. Increased efficiency of heat transfer results without causing the airflow to dwell turbulently at each louver; greater heat transfer efficiency is obtained without increase in power required. Further, the louver patterns of the present invention in effect translate the airflow (delivers it to adjacent fins, then to continue in the original airflow direction) to permit wider spacings between the fins.

In three of the four "staggered louver" embodiments here shown, the louver patterns are radially symmetrical about a center point. Such radial symmetry adds the further advantage that the airflow across the plane of the fin stock may be "bi-directional," that is, in either direction. This affords an additional advantage; it permits random assembly of the stamped-out fins with the tubing of a heat exchanger.

BRIEF DESCRIPTION OF THE DRAWINGS

FIG. 1 is a plan view of a two-row strip of bi-directional fin stock embodying the present invention.

FIG. 2 is an enlarged cross-sectional view of the two-row strip of fin stock taken along line 2—2 of FIG. 1.

DESCRIPTION OF THE PREFERRED EMBODIMENT

Figure 3:
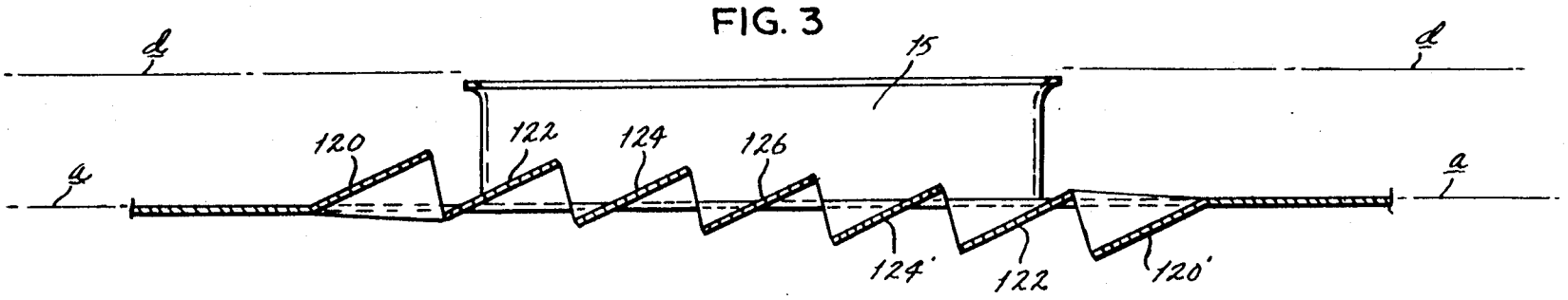
FIG. 3 is a similar view of a first modified embodiment of the invention, with the louver edges spaced, relative to the plane of fin stock, to range progressively from entirely above that plane to entirely below.

The bi-directional fin stock of the present invention, generally designated 10 and illustrated in FIG. 1, is made from generally planar fin stock, preferably aluminum or other ductile sheet metal characterized by a comparable or at least a favorable co-efficient of thermal conductivity. After the rows of louvers 18 and tube collars 15 are stamped and formed, the fin stock 10 is cut into ribbon-like strips normally one to four rows wide.

The fin stock 10 surface area has a pattern of parallel louvers generally designated 18, radially symmetrical relative to a central axis, here shown to be the axis b—b connecting the centers of the tube collars 15. Referring to the enlarged FIG. 2, which shows a first embodiment of the present invention, each louver is substantially flat; the mouths of the three louvers 20, 22, 24 on the left side of this chosen axis face the axis; and the symmetrically opposite louvers 20', 22', 24' also face it. Louvers 20, 22, 24 on one side of the pattern project upward, in their entirety, from the plane a—a of the fin stock 10, those louvers 20', 22', 24' on the other side of the center project downward, in their entirety, from that plane, while the louver 26 at the center of the pattern projects half above and half below the plane. All louvers may be bent at an angle of roughly 30°.

The outer edges of the outermost louvers 20, 20' of each pattern are formed by bending from the plane a—a of the fin stock 10 at each said louver's outer edges, and are slit from the plane a—a of the fin stock 10 at the louver's 20, 20' inner edge. A narrow bridge portion 21, 21' is formed between the inner edge of the outermost louvers 20, 20' and the adjacent louvers 22, 22'. Other than as so recited, the parallel edges of all the louvers are slit from the fin stock.

Referring again to the plan view FIG. 1, the pattern of louvers 18 is such that the length of the louvers, between successive tube collars 15, increases progressively from the center louver 26, which is the shortest louver, outward in either direction to the outermost louvers 20, which are longer than the spacing between the tube collars 15. Each pattern of louvers 18 separates the adjacent tube collars 15, which extend along an axis b—b from one side of the plane a—a of the fin stock 10. Where, as shown in FIG. 1, two rows of tubes are to be utilized, the axes b—b of the two rows of collars 15 are parallel to the longitudinal axis c—c of the fin stock 10. For ease of assembly, the height of the tube collars 15 determines the spacing of the layers of fin stock 10 from each other in an assembled heat exchanger, that is, from the plane a—a to the superjacent plane d—d where the nearest-above louver will be mounted.

The fin stock 10 shown in FIG. 2 is illustrated as having two rows of the patterns 18, these rows being separated by a flat median 32 which runs parallel to the longitudinal axis of the fin stock 10 and is equidistant between the rows. The rows of tube collars 15 are alternately staggered.

The longitudinal edges of said fin stock 10 may be conventionally crimped to provide structural strength. For clarity, this is not shown in the drawings.

Figure 4:
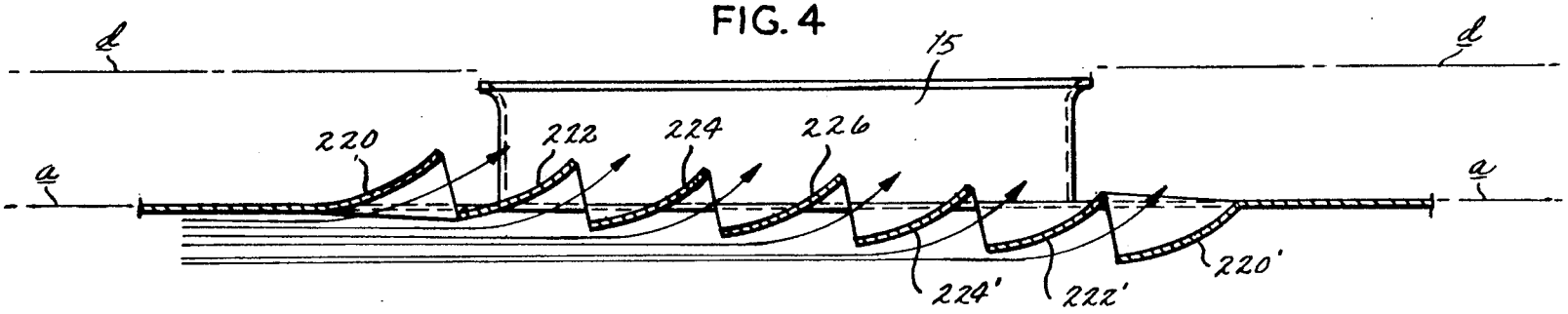
FIG. 4 is a further modified embodiment, generally similar to FIG. 3, but with the louvers formed to simple curvature, to turn the air as shown by the airflow arrows, in the manner of a turning vane.
Figure 5:
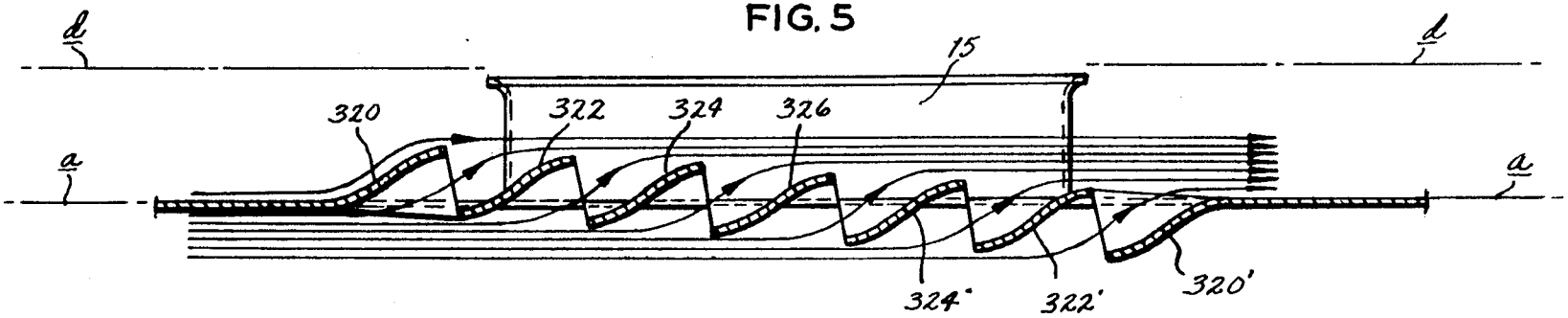
FIG. 5 is a still further modified embodiment whose louvers are formed to a reversing compound curvature. The arrows depict progressive translation of the airflow with a minimum of turning.

Considering airflow to be from the left in FIG. 2, it is first to be noted that, in this embodiment, as in the embodiments of FIGS. 3, 4 and 5, the pattern of louvers intercepts twice the width of air stream as if all the louvers had been formed to the same side of the plane a—a. Even more uniquely, each louver pattern translates the airstream (delivers it to adjacent fins, then to continue in the original airflow direction). The translational effect will be described in greater detail in the description of the embodiments of FIGS. 3, 4, and 5.

It is to be understood that all the discussion of airflow herein necessarily overlook factors as turbulence in the air stream flowing to the fin stock as well as the turbulence resulting from the louvered fin stock itself; no representation is made of achieving true streamline flow.

In the FIG. 3 embodiment of the invention, the outer louvers 120 and 120' and the central louver 126 are positioned the same as in the earlier embodiment of FIG. 2 relative to a tube collar 15, whose height determines the spacing of the fin plane a—a to the plane d—d of an adjacent fin. The difference in louver construction is in the progressive displacement, relative to plane a—a, of the leading edges of all the louvers, that is louvers 120, 122, 124, 126, 124', 122' and 120'. These louvers are patterned in a graduated array in which the louver farthest from center at one side therefrom projects, in substantially its entirety, into the airstream at one side of the plane a—a and the louver farthest from center on the opposite side similarly projects, in substantially its entirety, into the airstream at the other side of this plane. Such progressive leading edge displacement applies whether the airflow is from the left or the right of the drawing; each louver leading edge, so displaced from the plane a—a, intercepts a successive shallow portion or segment of the airflow. Even considered without the translational effect, such width of interception permits relatively wide spacing between the fin planes a—a and d—d.

A further modified embodiment of the invention, which may be used advantageously when large fin spacing is a principal consideration is shown in FIG. 4. This may be referred to as the "turning vane" louver pattern. In it, the leading edges of the louvers 220, 222, 224, 226, 224', 222', 220' are progressively staggered in the same manner as in the embodiment of FIG. 3, so that each louver "scoops up " a previously undisturbed layer of air (as shown by the air inflow arrows). However all these louvers are formed to simple concave curvature, to turn the air through an arc which may be approximately 30°. While the resultant airflow is angularly "turned" as shown by the outflow arrows, it very soon resumes its original direction; hence the ultimate effect is generally to translate the airflow. While the FIG. 4 configuration may afford wider fin spacing, and with somewhat greater turbulence and power requirement than the other configurations shown, its principal disadvantage is that it is not strictly bi-directional and does not permit random assembly.

A still further modified embodiment is shown in FIG. 5, in which the louvers 320, 322, 324, 328', 324', 322' and 320' have their leading edges similarly progressively staggered from the plane a—a of the fin stock, but with their curvature reversed. The curvature is specifically as follows: each louver slopes from its leading edge at a slight angle to the fin stock plane a—a to an increasing angle relative thereto, and then, in reverse curvature, to a decreasing angle as its trailing edge is approached. While the inflow to those louvers is shown by the inflow arrows to be like the FIG. 4 embodiment, here the "reverse curve" louver profile discharges the airflow in a pattern which, in the absence of turbulence, would approximate a buildup of substantially parallel planes close to the plane of the fin stock a—a, translating the entire impinging airstream upward relative to the plane of the fin stock a—a.

Wind tunnel tests with an experimental louver, a scaled up model of the original profile FIG. 2, show a far greater translational displacement of the airflow than is depicted in FIG. 5. In these tests the airstream appeared to be violently deflected by the louvers, to straighten out only as it was entrained into the inflowing airstream. Such deflection assures that air, not theretofore substantially heated, will flow across the louvers which have not theretofore been substantially cooled. Each of the bi-directional patterns, embodiments FIGS. 3, 4 and 5, remains bi-directional regardless how many rows of such patterns each fin may include; also that each of these patterns has a center of radial symmetry at least the greater part of the louver area of the louvers on one side of the center extends outward from one side of the plane of the fin, and at least the greater part of the louver area of the louvers on the other side of center extends outward from the other side of the plane of the fin.

The embodiments shown in FIGS. 3, 4 and 5 each exemplify a substantial improvement in solving the prior art problem: that heat exchange capacity is wasted if fin portions subsequent to the first in line of air flow is wasted when subjected to air already heated by flow over the first fin portions. The air flow arrows in FIG. 5 show the leading edges of the successive louvers, each extending into the airflow farther than the louver preceding it, tend to scoop up previously unheated air. The FIG. 3 embodiment acts in the same manner, in the progressive projection into the airstream of the center louver 126 and the last louver 120'.

The wind tunnel tests of a scale model of the FIG. 2 construction are interpreted as indicating that, at the relatively wide fin spacing of 12½ fins per inch (increased from the prior 14 fin/inch spacing) there will be an approximate 5% improvement in the "S.E.E.R." rating as compared to the fins made according to my U.S. Pat. No. 4,709,753. The "S.E.E.R." designation is the "seasonal energy efficiency ratio" rating as promulgated by the United States Department of Energy. From these tests, each of the FIGS. 2, 3, 4 and 5 configurations here shown is believed to be measurably more efficient—at least approximately 3% to 4%—than known fin constructions in commercial use.

As various modifications may be made in the constructions herein described and illustrated without departing from the scope of the invention, it is intended that all matter contained in the foregoing description or shown in the accompanying drawings shall be interpreted as illustrative rather than limiting.

I claim:

1. For use in a fin-and-tube heat exchanger, a generally planar fin having at least one pattern of louvers formed to project from the plane of the fin, said pattern being radially symmetrical about an axis in the plane of the fin and having a plurality of louvers on each side of said axis, in which pattern those opposite louvers outermost from said axis extend substantially in their entirety to one side of said plane, and in which each of the louvers has a portion in the plane of the fin, and at least the greater part of each louver intermediate said axis and an outermost louver extends to the same side of said plane as said outermost louver.

2. For use in a fin-and-tube heat exchanger, a fin as defined in claim 1, wherein each louver in said pattern subsequent to an outermost louver therein has a leading edge extending into such airflow successively farther than the louver proceeding it.

3. For use in a fin-and-tube heat exchanger, a fin as defined in claim 1, wherein said louvers are in a graduated array wherein the louver outermost from said axis at one side therefrom projects substantially in its entirety into the air stream on one side of the plane of said fin substantially in its entirety, the louver outermost from said axis on the other side thereof extends substantially in its entirety into the air stream on the opposite side of the plane of said fin, and the louvers therebetween extend in a progressively graduated array between said outermost louvers.

4. For use in a fin-and-tube heat exchanger, a fin as defined in claim 1, wherein each said louver is flat, whereby to intercept airflow in either direction across it and to effect translation thereof with substantially equal effectiveness.

5. For use in a fin-and-tube heat exchanger, a fin as defined in claim 1, wherein, considered in the direction of airflow, each fin is concave, whereby the pattern of louvers serves to displace the airflow in the manner of a turning vane.

6. For use in a fin-and-tube heat exchanger, a fin as defined in claim 1, wherein each said louver is of reversing curvature sloping from an airflow leading edge, at a slight angle relative to said plane, to an increasing angle relative thereto and then in reverse curvature to a decreasing angle as a trailing edge of said louver is approached.

* * * * *